US005361908A

United States Patent [19]

Drew et al.

[11] Patent Number: 5,361,908

[45] Date of Patent: Nov. 8, 1994

[54] DISPENSING CONTAINER

[76] Inventors: David M. Drew, 240 N. Branch, Glenview, Ill. 60025; Robert E. Drew, 163 Abingdon Ave., Kenilworth, Ill. 60043

[21] Appl. No.: 150,840

[22] Filed: Nov. 12, 1993

[51] Int. Cl.[5] ..... B65D 83/04

[52] U.S. Cl. ..... 206/536; 206/538; 206/37; 206/1.5

[58] Field of Search ..... 206/1.5, 541, 38, 37, 206/528, 533, 535, 536, 538

[56] References Cited

U.S. PATENT DOCUMENTS

| | | | |
|---|---|---|---|
| 1,817,562 | 8/1931 | Hodge | 206/533 X |
| 1,896,827 | 2/1933 | Neely | 206/533 X |
| 2,011,394 | 8/1935 | Bruns et al. . | |
| 2,046,869 | 7/1936 | Burke . | |
| 2,236,224 | 3/1941 | Raschkind | 206/533 |
| 2,975,887 | 3/1961 | Weingart . | |
| 3,020,659 | 2/1962 | Paulini . | |
| 3,561,592 | 2/1971 | McCool . | |
| 3,586,159 | 6/1971 | Kirchner et al. . | |

*Primary Examiner*—Jacob K. Ackun, Jr.

*Attorney, Agent, or Firm*—Greer, Burns & Crain, Ltd.

[57] ABSTRACT

An improved dispensing container for articles with the container having a lower, generally cylindrical receptacle rotatably interconnected to a cover, the cover and the receptacle form a chamber for containing the articles. An opening, sized for the passage of the articles therethrough, is formed in the cover. The lower receptacle also has an upward extending interior wall which forms at least a portion of a boundary wall of a blank cell closed to the intrusion of the articles within the chamber. The opening is positioned on the cover to move into and out of registration with the cell upon rotation of the cover relative to the receptacle, wherein upon registration between the cell and the opening, the articles are prevented from being dispensed from the chamber. A first pair of downward depending projections are attached to the cover to restrain the movement of the cover relative to the lower receptacle when the opening is registered with the blank cell and a second pair of downwardly depending projections are attached to the cover and configured to contact the interior wall for constraining the movable position of the opening relative to the lower receptacle within an arc.

11 Claims, 1 Drawing Sheet

DISPENSING CONTAINER

FIELD OF THE INVENTION

This invention relates generally to containers for dispensing articles and more particularly to a dispensing container for dispensing spherical objects such as gumballs and the like.

BACKGROUND OF THE INVENTION

Gumballs are typically packages in elongated cellophane packages which are then placed in display boxes for retail. Once purchased, the cellophane packages may continue to be used to contain the gumballs. However, such use has several drawbacks. Once these packages have been opened, typically by tearing one end, they may be difficult to close sufficiently to retain those gumballs remaining in the package. In addition, unless the package is tightly closed, foreign objects may enter into the package and come into contact with the gumballs. Also, once opened by tearing, the packages have a tendency to rip further which negates their ability to contain the remaining gumballs.

Another drawback of the cellophane packaging is the inability of the package to indicate when it has been adequately closed to prevent the inadvertent dispensing of gumballs. In addition, the elongated nature of the packaging is not particularly suited to being retained in a pocket. A further drawback is the cellophane wrapper has little structural integrity, and the gumballs may be crushed if sufficient force is applied to the wrapper.

It is therefore an object of the present invention to provide an improved dispensing container for articles such as gumballs which may be easily opened and closed to allow the selective dispensing of the gumballs. A related object is to provide such a container which maintains its containing capability after the container has been initially opened.

It is a further object of the present invention to provide an improved dispensing container which includes an indication as to when the container has been closed in a manner which prevents the inadvertent dispensing of the gumballs. A related object is to provide such a container which may be easily reopened.

A still further object of the present invention is to provide an improved dispensing container, which when closed, prevents the intrusion of foreign objects into the space containing the articles.

Another object of the present invention is to provide an improved container for gumballs which will fit in a typical pocket. A related object is to provide such a container which protects the gumballs from being damaged while in the pocket.

SUMMARY OF THE INVENTION

Accordingly, a dispensing container for articles is provides with the container having a lower, generally cylindrical receptacle with a generally circular bottom plate and a wall extending upward from the circumferential edge of the plate. A cover has a downwardly depending wall which is rotatably interconnected with the wall of the lower section, the cover and the receptacle form a chamber for containing the articles. An opening, sized for the passage of the articles therethrough, is formed in an upper plate of the cover. The container also has a interior wall connected to and extending upward from the bottom plate to form at least a portion of a boundary wall of a blank cell closed to the intrusion of the articles within the chamber. The opening is positioned on the upper plate to move into and out of registration with the cell upon rotation of the cover relative to the receptacle, wherein upon registration between the cell and the opening, the articles are prevented from being dispensed from the chamber. A first pair of downward depending projections are attached to the cover to restrain the movement of the cover relative to the lower receptacle when the opening is registered with the blank cell and a second pair of downwardly depending projections are attached to the cover and configured to contact the interior wall for substantially limiting the movable position of the opening relative to the lower receptacle within an arc.

DESCRIPTION OF THE PREFERRED EMBODIMENTS

Figure 1:
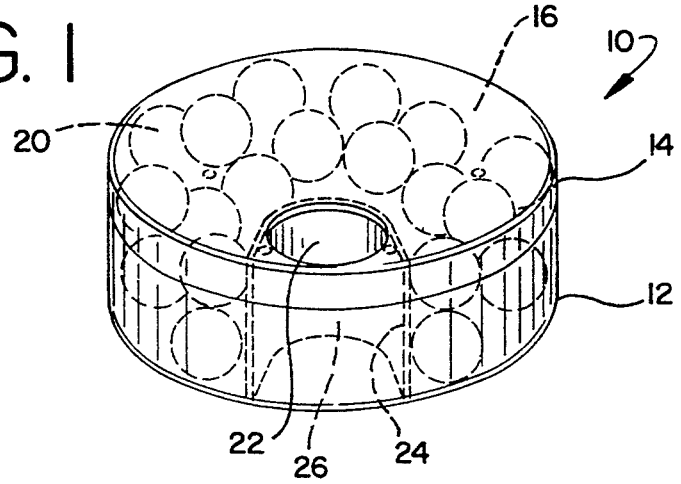
FIG. 1 is a front perspective view of a dispensing container embodying the present invention.

Referring to FIG. 1, a dispensing container embodying the present invention is generally indicated at 10. The dispensing container may include a lower generally cylindrical receptacle 12 and an upper cover 14 mounted on top of the receptacle in a manner which allows rotatable movement of the cover relative to the receptacle. The receptacle 12 and cover 14 define a chamber 16 in which objects such as gumballs 20 may be retained. The cover 14 forms an opening 22 which is preferably sized to allow the passage of the objects through the opening.

The container 10 also includes a interior wall 24 which is preferably integrally connected to the lower receptacle 12. The interior wall 24 and receptacle 12 form a blank cell 26 within the chamber 16 with the interior wall preventing the intrusion of gumballs 20 from the chamber into the blank cell.

Figure 2:
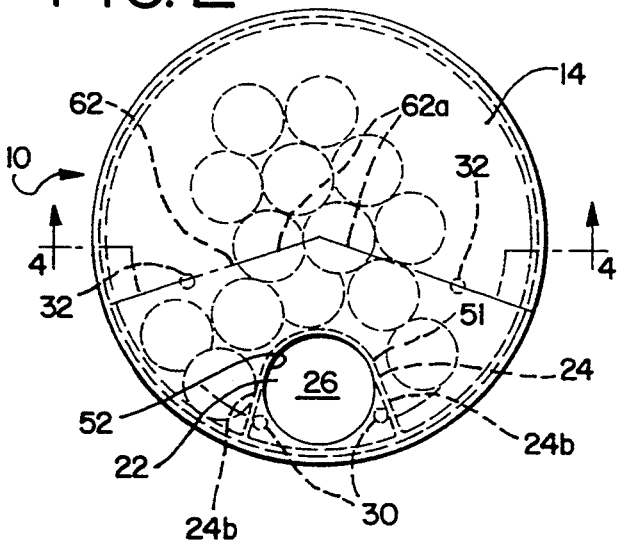
FIG. 2 is a top planar view of the dispensing container of FIG. 1.

The opening 22 is arranged on the cover 14 so that rotational movement of the cover relative to the receptacle 12 causes the opening 22 to move into and out of registration with the blank cell 26. When the opening 22 is registered with the blank cell 26, the container 10 defines a closed position which prevents the dispensing of gumballs 20 as shown in FIG. 2. The cover 14 may then be rotated relative to the receptacle 12 clockwise or counter-clockwise, when viewed from above, to a position whereby the gumballs may then be dispensed through the opening 22 thus defining an open position. An example of the open position is shown in FIG. 3.

Referring to FIG. 2, the cover 14 may also include a set of restraining means 30 which restrict rotational movement of the cover 14 relative to receptacle 12 when the opening 22 is registered with the blank cell 26. In addition, the cover 14 may include a set of stop means 32 which engage the interior wall 24 to substantially limit movement of the opening 22, relative to the receptacle 12, outside of a predetermined arc.

Figure 4:
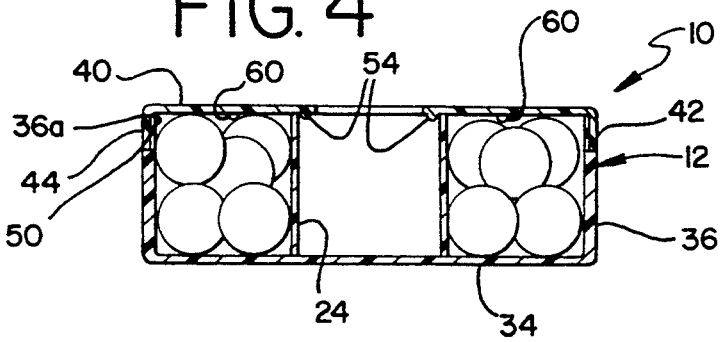
FIG. 4 is a sectional view taken generally along the line 4—4 in FIG. 2 and in the direction generally indicated.

Referring to FIG. 4, more particularly, the receptacle 12 includes a generally circular base plate 34 and a tubular wall 36 which extends generally vertically upward from the circumferential periphery of the base plate. The cover 14 includes a top plate 40 and a tubular wall 42 which extends downward from the peripheral edge of the top plate. The downward wall 42 is configured to fit about a thinner upper edge portion 36*a* of the wall 36 of receptacle 12. To allow rotatable movement of the cover 14 relative to the base, the edge portion 36*a* includes a radially outward extending annular rib 44 which is received in a groove 50 formed in the wall 42.

Figure 3:
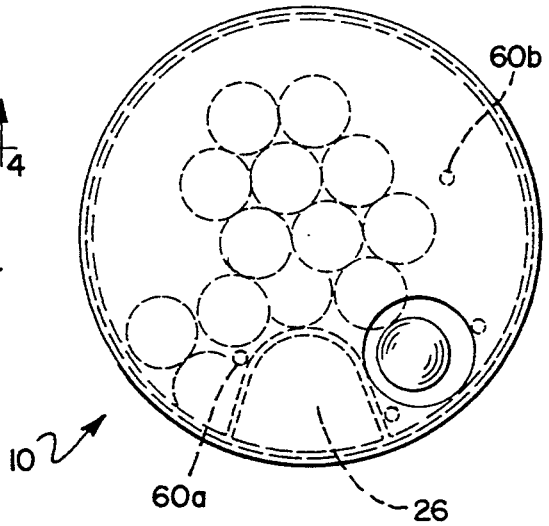
FIG. 3 is a top planar view of the dispensing container of FIG. 1 in the closed position.

Referring to FIG. 3, the interior wall 24 may be connected to either the base plate 34 or the wall 36 but is preferably connected to both. To maximize the volume of the gumball bearing portion of the chamber 16, the opening 22 in the cover 14 and the interior wall 24 are configured so that the volume of the blank cell 26 is minimized. To achieve this minimal volume, the opening 22 is circular and has a circumference which generally conforms to the shape of the gumballs 20. Also, the interior wall 24 has a concave configuration, when viewed from above, with a circularly curved inward section 24*a* and two planar leg sections 24*b* which extend from the edges of the curved section 24*a* radially outward to the wall 36. The outward edges of the leg sections 24*b* are integrally connected to the wall 36 of the retainer 12 with the interior wall 24 and the portion of the wall between the leg portions defining a boundary wall 51 which encircles the blank cell 26.

The opening 22 is disposed adjacent the peripheral edge of the base plate 34, and the interior wall 24 is sized so that when the opening 22 is registered with the blank cell 26, the curved inward section 24*a* of the interior wall conforms to the radially inward portion of a peripheral edge 52 which defines the opening.

As can be seen in FIG. 2, when the container 10 is in the closed position, foreign articles may enter into the blank cell 26 through the opening 22. By conforming the curved upper edge of the interior wall 24 to the peripheral edge 52, the interior wall prevents the foreign articles which may enter the container 10 through the opening 22 from entering that portion of the chamber having the gumballs 20. In addition, referring to FIG. 4, the interior wall 24 is configured so that the upper edge of the interior wall is in close proximity to the top plate 40. Thus, when the cover 14 is rotated relative to the receptacle 12 to open the container 10 to dispense the gumballs 20, foreign articles which may have entered into the blank cell 26 through the opening 22 are prevented from migrating into the article containing portion of the chamber 16.

The opening 22 and interior wall 24 are also configured to minimize the amount of material required for fabricating the interior wall 24. The interior wall 24 is preferably thin in cross-section and is integrally connected to and extends vertically upward from the base plate 34.

The restraining means 30 include a pair of projections 54 which downwardly depend from the top plate 40. The projections 54 are spaced on the top plate 40 so that when the opening 22 is registered with the blank cell 26, each of the projections 54 extend within the blank cell 26 and are adjacent the opposing leg portions 24*b* of the interior wall 24. The projections 54 are sized so that the contact between the projection and the respective leg portions 56 resists the rotational movement of the cover 14 relative to the receptacle but does not prevent such relative rotational movement if a normal torque is applied. Instead, if a normal torque is applied to the cover 14, the torque causes the cover to rotate relative to the receptacle 12 to rotate the opening 22 out of registration with the blank cell 26. The movement of the projection 54 across the interior wall 24 causes a clicking sound to indicate to the user the opening of the dispensing container 10.

The limiting means 32 include a pair of projections 60 which are integrally formed with and downwardly depend from the top plate 40. Each of the projections 60 is sized so that during rotation of the cover 14 relative to the receptacle 12 a contact between one of the projections and the interior wall 24 substantially limits further relative rotation of the cover 14. However, if sufficient torque is applied to the cover, additional rotation may be obtained.

The projections 60 are located on the lower surface of the top plate 40 at positions which substantially limit the rotational movement of the blank cell 26 relative to the cover 14 within an arc 62. The arc 62 being defined by imaginary radial lines 62*a* on the top plate 40 which extend through each of the projections 60. For example, referring to FIG. 3, projection 60*a* is positioned to contact the interior wall 24 when the cover 14 has been rotated counter-clockwise, when viewed from above, from the closed position to a position whereby the interior wall 24 does not interfere with the exit of gumballs 20 through the opening 22 as shown in FIG. 3. Projection 60*b* is positioned to contact the interior wall 24 so that when the cover 14 is rotated clockwise, when viewed from above, relative to the receptacle 12 to a point where the interior wall 24 does not prevent the dispensing of gumballs 20 through the opening 22. Thus, it can be seen that by using a pair of stop projections 60, the cover 14 may be rotated relative to the receptacle 12 in either a counter-clockwise or clockwise direction to a position where gumballs may be dispensed through the opening. The two positions where gumballs may be dispensed defining the open positions of the container.

Referring to FIGS. 1 and 4, in use, the chamber 16 of the dispensing container 10 may be filled with gumballs 20 and then the cover 14 may be snapped onto upper edge portion 44 the wall 36 of the receptacle 12 so that the rib 46 engages the groove 50. It is preferred that when the cover 14 is snapped onto the receptacle 12, the opening is registered with the blank cell 26 to place the container 10 in the closed position. With the container 10 in the closed position, the restraining projections 54 contactingly engage the opposing leg portions 24*b* of the interior wall to resist the relative rotational movement of the cover 14 relative to the receptacle 12.

To dispense a gumball 20 from the chamber 16, the cover 14 and receptacle 12 are grasped, and the cover is rotated relative to the receptacle in either a counter-clockwise or clockwise direction. The rotation will initially be hindered due to the restraining projections 54, however, normal force rotates the cover 14 disengaging the projections 54 from the interior wall 24 thereby causing a clicking sound which indicates the movement of the cover from the closed position. When the opening 22 has been rotated a sufficient distance so that the interior wall 24 no longer interferes with the dispensing of gumballs 20 from the chamber 16 through the opening, one of the pair of stop projections 60 engage the interior wall 24 to substantially limit further relative rotation. The container 10 is thus placed in one of the open positions.

The gumball 20 is then dispensed from the container 10 typically by turning the container upside down and shaking the container until a gumball 20 falls through the opening. After the gumball has been dispensed, the cover 14 is rotated relative to the receptacle 12 from the open position back into the closed position. When the blank cell 26 is registered with the opening 22, the restraining projections 64 engage the interior wall 24 to restrain the cover 14 from further rotation thus positioning the cover in the closed position.

A specific embodiment of the novel dispensing container according to the present invention has been described for the purposes of illustrating the manner in which the invention may be made and used. It should be understood that implementation of other variations and modifications of the invention in its various aspects will be apparent to those skilled the art, and that the invention is not limited by the specific embodiment described. It is therefore contemplated to cover by the present invention any and all modifications, variations, or equivalents that fall within the true spirit and scope of the basic underlying principles disclosed and claimed herein.

Various features of the present invention are set forth in the following claims.

What is claimed is:

1. A dispensing container for articles comprising:

a lower, generally cylindrical receptacle having a generally circular bottom plate and a wall extending upward from the circumferential edge of said plate;

a cover having a downwardly depending wall rotatably interconnected with said wall of said lower section, said cover and said receptacle forming a chamber for containing the articles, said cover having an upper plate forming an opening, said opening sized for the passage of the articles therethrough;

an interior wall connected to one of said bottom plate and said wall of said lower receptacle and extending upwardly from the bottom plate to form at least a portion of a boundary wall of a blank cell closed to the intrusion of any articles from within the chamber, said opening being positioned to move into and out of registration with said cell wherein upon registration between said cell and said opening, an interior of said cell is accessible through said opening and the articles are prevented from being dispensed from said containing space;

a first pair of downward depending means, attached to said cover, for resisting rotational movement of said cover relative to said lower receptacle when said opening is registered with said blank cell;

a second pair of downwardly depending means attached to said cover, said means adapted to contact the interior wall for substantially limiting the rotational movement of said cover between first and second positions at which positions said opening is registered with said chamber.

2. The container of claim 1 wherein each of said depending means is positioned adjacent a portion of said interior wall when said opening is registered with said blank cell.

3. The container of claim 1 wherein said interior wall is integrally connected to said bottom plate.

4. The container of claim 1 wherein said interior wall includes a top edge configured to be in close proximity to said top plate.

5. The container of claim 1 wherein said interior wall includes an inner section having a generally circular horizontal cross section and a pair of planar leg portions extending generally radially outward from the ends of said inner section to said wall of said receptacle, said leg portions being integrally connected to said wall, said interior wall and said wall of said receptacle, between the attachment of said leg portions to said wall, forming said boundary wall of said blank cell.

6. The container of claim 5 wherein said opening is bounded by a peripheral edge, said inner section of said interior wall conforming to a radially inward portion of said peripheral edge when said opening is registered with said blank cell.

7. The container of claim 1 wherein said opening is circular.

8. The container of claim 1 wherein said arc includes a closed position wherein said opening is registered with said blank cell and at least one open position wherein said interior wall does not prevent the article from exiting said chamber through said opening.

9. The container of claim 8 wherein said arc includes a plurality of open positions, at least one of said open positions being in either rotatable direction from said closed position.

10. The container of claim 1 wherein said first position includes a first open position whereby said interior wall does not interfere with the passage of the objects from said container, said first open position being in a first rotational direction from a closed position whereby said opening is registered with said blank cell, said second position includes a second open position whereby said interior wall does not interfere with the passage of gumballs from said chamber, said second open position being in a second rotational direction from said closed position, said second rotational direction being opposite from said first rotational direction.

11. A dispensing container for articles comprising:

a generally cylindrical receptacle having a bottom plate and a sidewall extending upwardly from said plate;

a cover having a generally circular upper plate and a downwardly depending wall rotatably interconnected with said sidewall, said cover and said receptacle forming a chamber for containing the articles, said upper plate having an opening sized for the passage of the articles therethrough;

an interior wall connected to at least one of said bottom plate and said sidewall, said interior wall extending upward from the bottom plate to form at least a portion of a boundary wall of a blank cell closed to the intrusion of any articles within the chamber, said opening being positioned to move into and out of registration with said cell wherein upon registration between said cell and said opening, an interior of said cell is accessible through said opening and the articles are prevented from being dispensed from said chamber;

a first pair of downwardly depending means attached to said cover for restraining the movement of said cover relative to said lower receptacle when said opening is registered with said blank cell, each of said restraining means being adjacent said interior wall when said opening is registered with said blank cell;

a second pair of downwardly depending means attached to said cover, said means adapted to contact the interior wall for substantially limiting the rotational movement of said cover relative to said receptacle between first and second positions at which positions said opening is registered with said chamber.

* * * * *